United States Patent [19]

Bachtell

[11] Patent Number: 4,984,590

[45] Date of Patent: Jan. 15, 1991

[54] HAIR STYLING COMB

[76] Inventor: Stephen R. Bachtell, 807 S. Hi-Lusi, Mt. Prospect, Ill. 60056

[21] Appl. No.: 334,903

[22] Filed: Apr. 7, 1989

Related U.S. Application Data

[63] Continuation-in-part of Ser. No. 9,353, Jan. 30, 1987, abandoned.

[51] Int. Cl.[5] ..... A45D 24/02

[52] U.S. Cl. ..... 132/161; 132/150; 132/219

[58] Field of Search ..... 132/148, 161, 219, 901, 132/150

[56] References Cited

U.S. PATENT DOCUMENTS

| | | | |
|---|---|---|---|
| 952,491 | 3/1910 | Youngs | 132/161 |
| 1,841,475 | 1/1932 | Greenwich | 132/161 |
| 2,380,730 | 7/1945 | Demyanovich | 132/161 |
| 2,508,363 | 5/1950 | Baldanza | 132/148 |
| 3,960,160 | 6/1976 | Hogan | 132/112 |
| 4,612,944 | 9/1986 | Bachrach et al. | 132/219 |

FOREIGN PATENT DOCUMENTS

| | | | |
|---|---|---|---|
| 0162420 | 5/1904 | Fed. Rep. of Germany | 132/161 |
| 1253367 | 1/1961 | France | 132/161 |
| 1263982 | 5/1961 | France | 132/161 |

*Primary Examiner*—John J. Wilson
*Assistant Examiner*—Frank A. LaViola, Jr.
*Attorney, Agent, or Firm*—Leydig, Voit & Mayer, Ltd.

[57] ABSTRACT

A comb for grooming full bodied hair having a handle portion, and an elongated tooth support portion extending longitudinally from the handle portion. A first set of relatively long and widely spaced teeth extend transversely from the tooth support portion such that upon passage through hair such teeth channel the hair without substantial resistance and without adversely affecting the body of the hair. A second set of substantially shorter length of teeth are provided, which each are disposed between a pair of the teeth of the first set such that when the teeth of the second set are passed through the hair a relatively small drag is created on the hair to permit precisely controlled contouring and styling thereof.

10 Claims, 1 Drawing Sheet

HAIR STYLING COMB

DESCRIPTION OF THE INVENTION

This application is a continuation-in-part of application Ser. No. 009,353 filed Jan. 30, 1987, now abandoned.

The present invention relates generally to hair combs, and more particularly, to an improved comb having particular applicability for use in hairstyling.

Professional hair stylists work with meticulous detail in cutting and contouring hair to the desired style and in a manner to bring out the natural curvature and lay of the hair in a full bodied fashion. During the course of such styling and subsequent combing, conventional combs frequently pull and stress the hair to such extent as to prevent it from assuming its styled or natural contour. This has been found to be a particular problem with combs having relatively short, closely spaced teeth. As such a comb passes through the hair, high frictional contact occurs between the hair and the teeth, creating a strong pulling effect as on the hair. Combs of this type also tend to create static electricity during use and are difficult to use on entangled hair. On the other hand, combs with relatively large and more widely spaced teeth generally have not been suitable for hair styling usage because of the difficulty in manipulating the hair with the necessary degree of control for establishing the desired contour.

It is an object of the present invention to provide an improved comb that is adapted to permit easy channeling, grooming, and styling of full bodied hair without substantial stress or pulling on the hair during combing.

Another object is to provide a comb as characterized above which is adapted to create relatively small drag on the hair so as to permit controlled contouring of the hair.

A further object is to provide a comb of the foregoing type which is particularly adapted for use on entangled hair.

Yet another object is to provide such a comb which reduces the potential for generating undesirable static electricity in the hair.

Still a further object is to provide a comb of the above kind which lends itself to more versatile use by professional hair stylists, including uses during cutting, combing, and picking of the hair, as well as usage on hairpieces.

Other objects and advantages of the invention will become apparent upon reading the following detailed description and upon reference to the drawings, in which.

Figure 1:
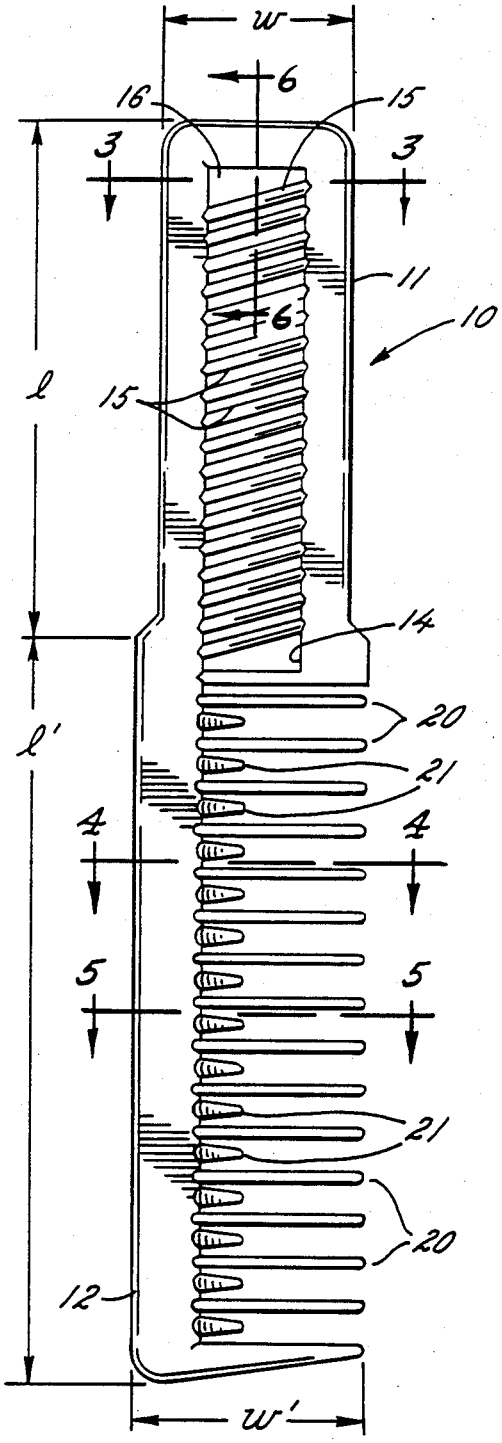
FIG. 1 is a plan view, drawn to actual size, of an illustrated comb embodying the present invention.
Figure 2:
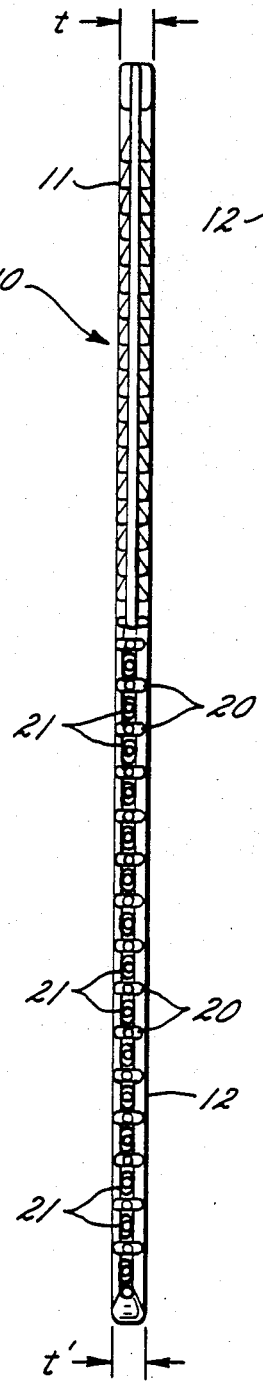
FIG. 2 is a side elevational view of the comb shown in FIG. 1.
Figure 3:
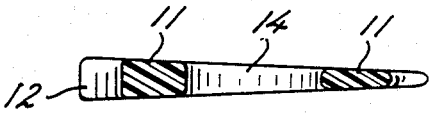
Figure 4:
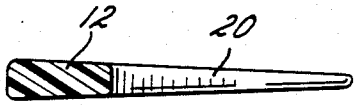
Figure 5:
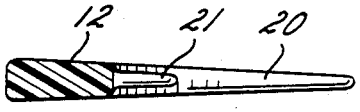
Figure 6:
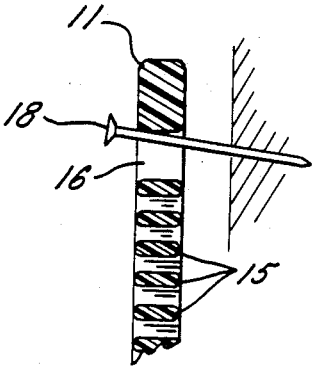
Figure 7:
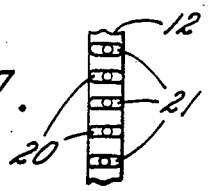
Figure 8:
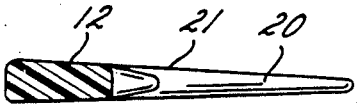

FIGS. 3, 4 and 5 are enlarged sections taken in the planes of lines 3—3, 4—4 and 5—5, respectively, in view FIG. 1; and FIG. 6 is an enlarged partial side elevation of the terminal end portion of the handle of the comb illustrating the manner in which the comb may be hung on a wall for storage;

FIG. 7 is a transverse section, similar to FIG. 5, but showing an alternative arrangement of the teeth of the comb; and FIG. 8 is a fragmentary side view of the comb with the alternative tooth arrangement shown in FIG. 7.

While the invention is susceptible of various modifications and alternative constructions, a certain illustrated embodiment thereof has been shown in the drawings and will be described below in detail. It should be understood, however, that there is no intention to limit the invention to the specific form disclosed, but on the contrary, the intention is to cover all modifications, alternative constructions and equivalents falling within the spirit and scope of the invention.

Referring now more particularly to the drawings, there is shown an illustrated comb 10 embodying the present invention. The comb 10 includes a handle portion 11 and a tooth supporting portion 12 extending longitudinally therefrom. The comb 10 preferably is molded of a durable plastic material.

To facilitate holding of the comb by a user, the handle portion 11 has a generally rectangular, flat, elongated configuration. The handle portion 11 preferably has a thickness t corresponding substantially to the thickness t′ of the tooth supporting portion 12, a width w corresponding substantially to, or slightly less than, the width w′ of the opposite tooth supporting end of the comb, and a length l no greater than the length l′ of the tooth supporting portion 12 of the comb. In the illustrated embodiment, the tooth supporting portion 12 preferably has a length l′ of about 4¼ inches so as to encompass the length of the average head of hair, and the handle portion has a length l of about 3 inches to provide adequate gripping by the hand. The overall length of the comb, which preferably is about 7¼ inches, still is sufficiently small to permit detailed manipulation of the hair during styling. The thickness of the handle and tooth supporting portions of the illustrated comb preferably is about 3/16 inches.

To minimize material during molding, the handle 11 is formed with a rectangular longitudinally extending opening 14 and a plurality of structural cross members 15. For the purpose of enabling hanging of the comb on a hook or the like, the cross members 15 are disposed in angular relationship to the sides of the handle so that a generally triangular opening 16 is defined between the terminal end of the handle and the immediately adjacent cross member 15. Hence, the comb 10 may be hung on the wall by positioning the handle opening 16 over a wall mounted nail 18 of the like, as depicted in FIG. 6.

In accordance with the invention, the comb has a first set of relatively long and widely spaced teeth so that upon passage through the hair such teeth channel the hair without substantial resistance and without adversely effecting the body of the hair, and a second set of relatively short teeth which each are disposed between a pair of teeth of the first set and have a length of about one fourth of the length of the teeth of the first set such that when the teeth of the second set are passed through the hair a relatively small drag is created on the hair to permit controlled contouring thereof. To this end, in the illustrated embodiment, the comb 10 has a first set of teeth 20 extending transversely of the tooth support portion 12 and disposed in a row. The teeth 20 of this first set are relatively long and are widely spaced with respect to each other. A second set of teeth 21 also extend transversely of the tooth support portion 12, with the each tooth 21 of the second set being disposed between a pair of teeth 20 of the first set and being substantially shorter in length, more specifically, having a length which is about one fourth of the length of the teeth of the first set.

The teeth 20 of the first set in this instance have a tapered configuration when viewed in a plane transverse to the longitudinal axis of the tooth support portion 12, with the width of each tooth 20 narrowing at greater distances from the tooth support portion. The teeth 21 of the second set each have a tapered configuration when viewed in the plane of the tooth support portion 12 with the width of each tooth 21 narrowing at a greater distance from the tooth support portion. FIG. 7 shows an alternative embodiment of the comb, identical to the embodiment of FIGS. 1–6, except that the teeth of the second set are oriented in planes parallel to the teeth of the first set such that they each have a tapered configuration when viewed in a plane transverse to the longitudinal axis of the tooth support portion 12.

The teeth 20 of the first set preferably have a length of about one inch and are spaced from each other by a distance of about ¼ of an inch. The teeth 21 of the second set preferably have a length of about ¼ inch and each are disposed between a pair of teeth 20 of the first set with a spacing of about ⅛ of an inch on each side of the outermost end of the teeth. By virtue of the tapered configuration of the teeth 21 of the second set, in the embodiment of FIGS. 1–6, such spacing narrows somewhat toward the base of each tooth. In practice, the advantages of the present invention have been achieved in a comb in which the relatively long and widely spaced teeth 20 of the first set have a length of 1 1/16 inch and are spaced from each other by a distance of about 7/32, and the teeth 21 of the second set have a length of ¼ inch and are disposed with a spacing of ⅛ inch between the outermost end thereof and the adjacent teeth 20 of the first set.

During use of the comb 10, it has been found that the relatively large and widely spaced teeth 20 of the first set are adapted to permit easy channelling of the hair without substantial stress or pulling on the hair during combing. These teeth permit the hair to be arranged in the desired silhouette without affecting the body of the hair. Moreover, because there is very little frictional pull exerted on the hair by the larger teeth 20, the potential for generating static electricity is minimized. The teeth 21 of the second set, which are disposed between the larger teeth with relatively smaller spacing, are adapted to create a small drag on the hair so as to permit precisely controlled contouring and styling of the hair. Hence, the comb 10 permits detailed styling and grooming of the hair without substantial stress or pulling forces being exerted on the hair, as is characteristic of conventional combs. The relatively larger teeth 20 of the first set further have the ability of combing badly tangled hair because they first move the hair in separate larger layers, before the smaller teeth 21 separate the hair into smaller, closer channels. Since hair normally has a natural bending length of approximately 1 inch to 1½ inches from the scalp, the larger teeth 20 of the first set have particular utility in channelling of the hair with the smaller teeth 21 of the second set contouring the hair at about its natural bending point. It will be appreciated that the comb is adapted for highly versatile use by professional hair stylists, such as use during cutting, combing, and picking of exceptionally curly hair, as well as use on hairpieces.

I claim:

1. A comb for grooming hair having full body comprising a handle portion, a straight elongated tooth support portion extending from said handle portion along a straight longitudinal axis, a first set of teeth extending in a direction transverse to said tooth support portion and disposed in a straight row, said teeth of said first set having straight sides and being of substantially uniform length of about one inch and spaced uniformly at intervals of about one fourth inch so that upon passage through hair the teeth of said first set channel the hair without substantial resistance and without adversely affecting the body of the hair, a second set of uniformly spaced teeth extending in a direction transverse to said tooth support portion, said teeth of said second set each being disposed between a pair of teeth of said first set and having straight sides and a discrete length which is no greater than one fourth of the length of the teeth of said first set such that when the teeth of said second set are passed through the hair a relatively small drag is created on the hair to permit controlled contouring thereof, and said teeth of said second set each having tapered configuration with relatively narrowed ends and being spaced from adjacent teeth of said first set by about one eighth inch.

2. The comb of claim 1 in which the teeth of said first set each have a tapered configuration with the width of the tooth narrowing at greater distances from said tooth support portion when viewed in a plane perpendicular to the longitudinal axis of said tooth support portion.

3. The comb of claim 2 in which the teeth of said second set each have a tapered configuration with the width of the tooth narrowing at greater distances from said tooth support portion when viewed in a plane parallel to the longitudinal axis of said tooth support portion.

4. The comb of claim 1 in which said handle portion comprises a generally flat rectangular configured elongated member.

5. The comb of claim 4 in which said handle is formed with a generally elongated rectangular opening which permits hanging of said comb from a terminal end of the handle.

6. The comb of claim 5 in which said handle is formed with a plurality of transversely spaced members extending across said opening.

7. The comb of claim 6 in which said transversely spaced members are disposed in parallel relation to each other and at an acute angle to a side of said elongated opening.

8. The comb of claim 4 in which said handle portion has a length no greater than the length of said tooth support portion.

9. The comb of claim 8 in which said tooth support portion has a length of about 4½ inches and said handle portion has a length of about 3 inches.

10. The comb of claim 8 in which said handle has a width in a direction parallel to the direction of the teeth of the first set corresponding substantially to the distance defined by said tooth support portion and length of the teeth of said first set.

* * * * *